US008714192B2

(12) United States Patent
Haltmayer et al.

(10) Patent No.: US 8,714,192 B2
(45) Date of Patent: May 6, 2014

(54) WATER CONDUCTING HOUSEHOLD APPLIANCE

(75) Inventors: Werner Haltmayer, Dinkelsbühl (DE); Bruno Reiter, Kösingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 233 days.

(21) Appl. No.: 12/846,864

(22) Filed: Jul. 30, 2010

(65) Prior Publication Data

US 2011/0036436 A1 Feb. 17, 2011

(30) Foreign Application Priority Data

Aug. 17, 2009 (DE) ..... 10 2009 028 587

(51) Int. Cl.
*F16K 21/04* (2006.01)

(52) U.S. Cl.
USPC ..... 137/533; 137/528

(58) Field of Classification Search
USPC ..... 137/614.2, 528, 532, 533, 534
See application file for complete search history.

(56) References Cited

U.S. PATENT DOCUMENTS 822,077 A * 5/1906 Rich ..... 137/513
1,516,368 A * 11/1924 Williston ..... 137/496
1,657,741 A * 1/1928 Carrey ..... 137/533
2,015,915 A * 10/1935 Adsit ..... 137/512
4,354,492 A * 10/1982 McPhee ..... 604/247
5,520,209 A * 5/1996 Goins et al. ..... 137/246
5,713,387 A * 2/1998 Armenia et al. ..... 137/312
5,725,018 A * 3/1998 Paczonay ..... 137/528
2003/0189002 A1* 10/2003 Proulx et al. ..... 210/284
2003/0233711 A1* 12/2003 Marsh et al. ..... 8/158
2005/0072725 A1* 4/2005 Swanson ..... 210/289
2005/0098492 A1* 5/2005 Harrison ..... 210/252
2008/0000098 A1* 1/2008 Choi et al. ..... 34/114
2009/0255590 A1* 10/2009 Enerson ..... 137/15.18
2010/0200087 A1* 8/2010 Andrews et al. ..... 137/528

FOREIGN PATENT DOCUMENTS

DE 1585830 A1 10/1970
DE 2106652 A1 8/1971
DE 2522443 A1 12/1976
DE 102007014386 A1 10/2008
GB 1372504 A 10/1974

* cited by examiner

*Primary Examiner* — Craig Schneider
*Assistant Examiner* — Umashankar Venkatesan
(74) *Attorney, Agent, or Firm* — James E. Howard; Andre Pallapies

(57) ABSTRACT

A water conducting household appliance having at least one water supply line to supply the household appliance with water from a water network; an inlet valve arrangement connected to the water supply line and the water network; and a backflow prevention apparatus arranged in the inlet valve arrangement. The backflow prevention apparatus allows water to flow only in the direction of the household appliance and prevents water to flow in the direction of the water network.

18 Claims, 7 Drawing Sheets

WATER CONDUCTING HOUSEHOLD APPLIANCE

BACKGROUND OF THE INVENTION

The invention relates to a water conducting household appliance, for example a household dishwasher or a household washing machine.

Water conducting household appliances, such as dishwashers or washing machines for example, have water connections, which can be used to connect the household appliances for example to the fresh water network. When such a household appliance is connected by way of a water supply line to the water network, it is possible for water in the water supply line to flow back into the water network.

BRIEF SUMMARY OF THE INVENTION

The object of the invention is to design a water conducting household appliance so that water present in a water supply line of the household appliances is prevented from getting into the water network.

The object of the invention is achieved by a water conducting household appliance, having at least one water supply line to supply the household appliances with water from a water network, which is connected to an inlet valve arrangement, which can be connected to the water network, a backflow prevention apparatus being disposed in the inlet valve arrangement, which is set up only to allow a flow of water in the direction of the household appliance but to prevent a flow of water in the direction of the water network. The inventive household appliance is a dishwasher or washing machine for example.

According to the invention therefore the household appliance comprises the backflow prevention apparatus connected in the inlet valve arrangement of the household appliance, which only permits water flowing through the inlet valve to flow in one direction, namely from the water network in the direction of the household appliance. Because the backflow prevention apparatus prevents a flow direction of the water in the water supply line away from the household appliance, i.e. in the backflow direction, in particular to the water network, this creates the conditions for water in the water supply line not to be able to flow back into the water network.

The invention allows a backflow of in particular contaminated water to be prevented, for example with the simultaneous connection of two water inlets, in particular for cold water and hot water to water conducting household appliances, in each instance by means of either a water stop valve, in particular an aquastop valve, or a simple valve.

To save energy water conducting household appliances can be connected both to hot and cold water supply lines. If one of the two inlets is not activated for quite a long period, bacteria can develop in the unused hose. When pressure differences occur between the two inlets, a backflow can result, causing contaminated water to be pushed into fresh water lines. Such backflows can be prevented by the use of non-return valves. Non-return valves can in particular have two housing halves with a sealing element located therein. The housing halves have to be secured to prevent them sliding apart as the pressure builds up, so they are welded together for example. Brackets or clamps can be used for connection to components or hoses.

According to the invention a backflow blocking device is integrated in each instance into the represent inlet valve arrangement, in particular into the respective water stop or simple valve housing. This can be achieved expediently with the aid of sealing disks or membrane rings, which have movable lips. Alternatively however a ball can be used as the backflow blocking device, closing off an in particular conical backflow opening. The advantage compared with known structures is also the saving relating to a separate housing and connecting parts such as hose units, brackets and the assembly outlay that would otherwise be necessary.

The inventive household appliance can preferably comprise a number of inlet valve arrangements to supply the household appliance with water from the water network, each of the inlet valve arrangements having a backflow prevention apparatus, which is disposed in each instance in the assigned inlet valve arrangement and is set up only to allow a water flow in the direction of the household appliance but to prevent a water flow in the direction of the water network. Such an embodiment can be provided for example, when the inventive household appliance is to be supplied with cold and preheated water, i.e. warm or hot water. It is then possible for one of the water supply lines to be connected to a cold water connection and the other to a warm or hot water connection.

According to one preferred variant of the inventive household appliance the inlet valve arrangement is part of a water stop valve arrangement. This preferably comprises an inlet valve at the upstream end of each water supply line of the household appliance. The inlet valve is for example a solenoid valve, in particular an aquastop valve or water stop valve, which can be opened and closed for example by a control apparatus of the inventive household appliance, in order for example to control the water supply to the inventive household appliance. For this variant the backflow prevention apparatus is therefore set up to prevent a water flow through the inlet valve in the direction of the water network.

An inlet valve and an associated water supply respectively can preferably form a water stop system. In some instance this has a safety mechanism, to prevent the inflow of water in the event of a defect, in particular in the water hose or water hoses, in that the control apparatus of the household appliance for example automatically blocks the inlet valve(s).

According to one preferred embodiment of the inventive household appliance the backflow prevention apparatus can be configured as a non-return valve. A non-return valve is set up to block the passage of the water flowing through it in the backflow flow direction, in this instance therefore in the direction of the water network, automatically. The non-return valve can be a spring-loaded non-return valve for example, in which a closing element is closed by a spring in the direction of the water network, while in contrast being opened in the direction of the household appliance by the water flowing through the water supply line, optionally through the water hose. The closing element used can be a ball, cone, flap or membrane for example that is pushed against an inlet or outlet of a through channel of the non-return valve by means of the spring.

According to one advantageous development of the invention the backflow prevention apparatus can have a sealing disk that is supported in a movable manner in the inlet valve arrangement, said sealing disk being moved into an open position by a water pressure of the water flow in the direction of the household appliance and being moved into a closing position by a water pressure of the water flow in the direction of the water network, in which closed position the sealing disk rests on a seat in a fluid-tight manner. To this extent the sealing disk can be displaced in an axial direction, in particular simply by the water pressure or the respective flow direction of the water through the valve arrangement. When the water flows in the direction of the household appliance, the sealing disk is pushed into its open position. However when the water wants to flow in the other direction, in other words in the direction of the water network, the sealing disk is pushed into its closing position, i.e. on the seat. There is therefore no need for separate control means to move the sealing disk. In particular no electrical energy is required for the purpose.

The sealing disk can expediently be disposed in a flow channel between a filter arrangement and a solenoid valve of the inlet valve arrangement. In this way the sealing disk is advantageously disposed in a space-saving manner in the inlet valve arrangement. There is no need for a separate valve housing. It is also possible to insert such a sealing disk into an existing inlet valve arrangement without modification or in any case with only minor modifications. The inventive backflow prevention apparatus can thus be produced economically.

The seat can in particular be formed by an insert with a seat surface in the manner of an annular disk, which has an annular rib projecting axially in the direction of the sealing disk, on which the sealing disk rests in the closing position. The axially projecting annular rib allows the sealing disk to rest on a small, in other words narrow, sealing surface, so that the sealing action is more precise or more efficient.

In addition to or independently of a sealing disk according to one advantageous variant of the invention the backflow prevention apparatus can have membrane ring for example secured in the inlet valve arrangement, which is reshaped elastically into an open position by a water pressure of the water flow in the direction of the household appliance, and a sealing lip of the membrane ring is pushed by a water pressure of the water flow in the direction of the water network, i.e. in the backflow direction, into a closing position, in which the sealing lip of the membrane ring rests on a seat in a fluid-tight manner. In the relaxed position of the membrane ring the sealing lip can rest on the seat in particular in a fluid-tight manner, so that even when there is no pressure in the inlet valve arrangement the backflow prevention apparatus is in the closing position. When there is a water pressure of the water flow in the direction of the water network the sealing lip is pushed to a greater degree, i.e. more strongly, onto the seat, so that a higher level of fluid-tightness is achieved.

The membrane ring can preferably be disposed in a flow channel between a filter arrangement and a solenoid valve of the inlet valve arrangement. This allows the membrane ring to be integrated into the inlet valve arrangement in a space-saving manner. There is no need for a separate valve housing. Such a membrane ring can also be inserted into an existing inlet valve arrangement without modification or in any case with only minor modifications. The inventive backflow prevention apparatus can thus be produced economically.

The seat for the membrane ring can expediently be formed by a disk-type insert, which has throughflow openings, which are closed off in the closing position of the membrane ring by the sealing lip of the membrane ring. The disk-type insert provides a unique, tailored bearing surface on the sealing lip of the membrane ring. This allows the sealing action to be improved.

According to one expedient development of the invention the disk-type insert can form an annular gap with the sealing lip of the membrane ring. The sealing lip here can be disposed with its free sealing lip edge inclined radially outward in the closing position of the membrane ring. This means that the water flowing through the valve arrangement can transmit strong forces to the sealing lip, which push the sealing lip with great force onto the seat or disk-type insert, to enhance the sealing action.

The inventive household appliance, in particular a dishwasher with a hot and cold water connection, which is configured in particular to allow the use of water heated by means of a solar unit, provides a backflow blocking device in the inlet valve of its respective water supply line, in particular in each instance in the tap termination side inlet valves of its hot water and cold water supply lines. The incorporation of the backflow prevention apparatus, in particular in the form of the non-return valve, in the water supply line prevents a backflow of water in the water supply line into the water network. It is possible to produce the inventive household appliance relatively economically in particular when the non-return valve is used.

The invention therefore relates in particular to a non-return valve for preventing backflow, which is integrated in the respective inlet valve, in particular of a water stop valve arrangement of a household appliance with one or optionally two water supply lines (hot and cold water).

Other embodiments and developments of the invention are set out in the subclaims. These and the advantageous embodiments and developments of the invention listed above can be utilized individually or in any combination in an inventive household appliance, in particular in an inventive dishwasher.

BRIEF DESCRIPTION OF THE DRAWINGS

The invention and its embodiments and developments and their advantages are described in more detail below with reference to schematic drawings, in which.

DETAILED DESCRIPTION OF EXEMPLARY EMBODIMENTS OF THE PRESENT INVENTION

Figure 1:
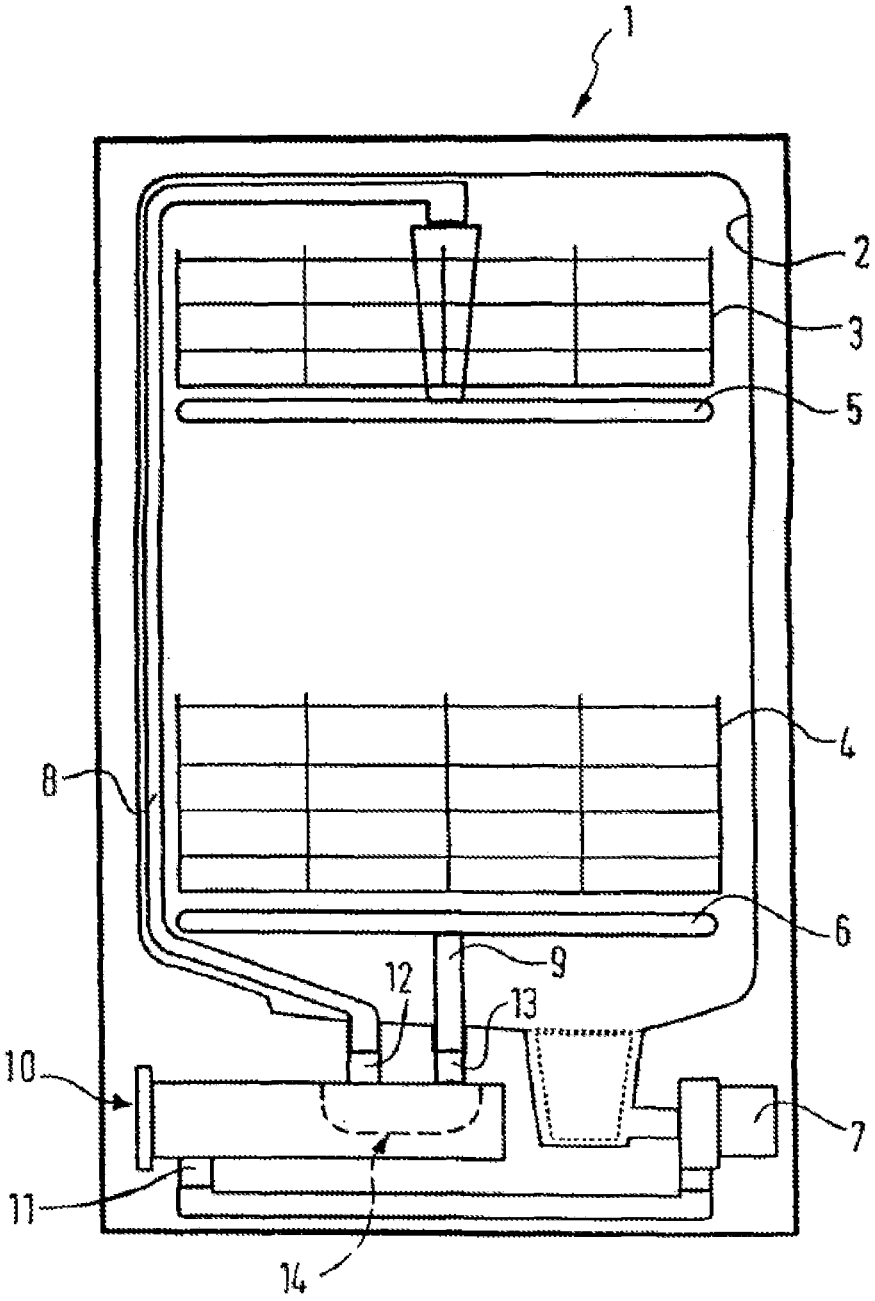
FIG. 1 shows a household dishwasher as an advantageous exemplary embodiment of an inventive household appliance.

Elements with identical function and mode of action are shown respectively with the same reference characters in FIGS. 1 to 5.

FIG. 1 shows a sectional diagram of a household dishwasher 1 as an example of a water conducting household appliance.

The household dishwasher 1 has a washing compartment 2 for receiving items to be washed, which can be divided into an upper dish rack 3 and a lower dish rack 4 for instance. At least two spray apparatuses for applying a fluid to the item to be washed are disposed in the washing compartment 2, said fluid generally being referred to as washing liquor. In the case of the present exemplary embodiment, the spray apparatuses are configured as upper and lower spray arms 5, 6. The fluid can be delivered by a circulating pump 7, by way of a first fluid supply line 8 to the upper spray arm 5 and by way of a second fluid supply line 9 to the lower spray arm 6. The circulating pump 7 is driven for example by means of an electrical drive (not shown in further detail) in particular by means of its electric motor.

The fluid can be heated at least in a subprogram step of a washing program of the household dishwasher 1 by means of a flow-through heater 10, which is connected by means of an inlet connection 11 to the circulating pump 7 and by means of outlet connections 12, 13 to the fluid supply lines 8, 9. The number of outlet connections 12, 13 corresponds to the number of spray arms 5, 6 or simultaneously operated sets of spray arms 5, 6. The fluid delivered by the circulating pump 7 is then routed to the inlet connection 11 of the flow-through heater 10 and from this latter's outlet connections 12, 13 by way of the fluid supply lines 8, 9 to the spray arms 5, 6.

The household dishwasher 1 also has a water switch 14, which is disposed in the flow-through water heater 10 or is molded thereon for example. The water switch 14 can however also be disposed on its own in the household dishwasher 1 or can be directly connected to the circulating pump 7 for instance. The water switch 14 enables each of the spray arms 5, 6 to be supplied alternately and/or continuously with the fluid. This is achieved by opening one fluid outlet and by closing another fluid outlet of the water switch 14.

Figure 2:
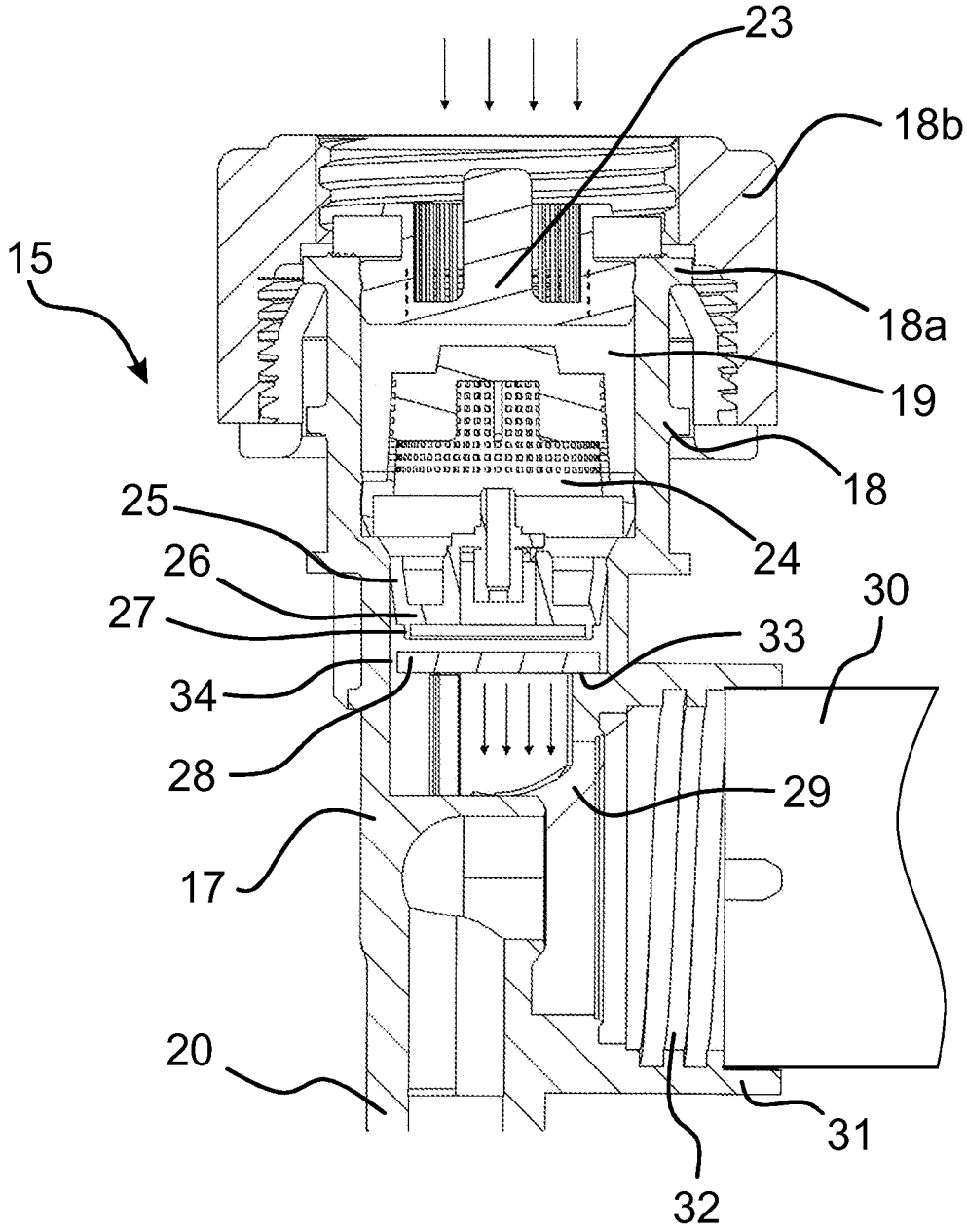
FIG. 2 shows a first advantageous embodiment of an inlet valve, which is configured as part of a water stop valve arrangement of the household dishwasher in FIG. 1, with a sealing disk in the open position.

FIG. 2 shows a first inlet valve arrangement 15, which is configured according to the inventive design principle. The inlet valve arrangement 15 is shown in a vertical operational installation position. The inlet valve arrangement 15 has a valve housing 17. An inflow connection 18 is molded on the upper end of the valve housing 17. From the upper inflow connection 18 a flow channel 19 passes through the valve housing 17 to a lower outflow connection 20. The inflow connection 18 has a union nut 18*b* supported in a rotatable manner on a collar 18*a*. The union nut 18*b* allows the inlet valve arrangement 15 or the valve housing 17 to be connected to a tap (not shown), in particular a wall connection. On the inlet side, in particular at the level of the inflow connection 18, a first filter arrangement 23 is inserted into the flow channel 19. A second filter arrangement 24 is inserted into the valve housing 17 downstream of the first filter arrangement 23, when viewed in the inflow direction.

A seat 25 is positioned in the valve housing 17 downstream of the first filter arrangement 23 and/or second filter arrangement 24. The seat 25 has a seat surface 26 in the manner of an annular disk facing downward as shown in FIG. 2. The seat surface 26 in the manner of an annular disk supports an annular rib 27. The annular rib 27 extends projecting axially from the seat surface 26 in the direction of a sealing disk 28 disposed in the valve housing 17. To this extent the sealing disk 28 together with the seat surface 26 and the annular rib 27 forms a first embodiment of an inventive backflow prevention apparatus 21.

The sealing disk 28 is disposed between the first filter arrangement 23 or the second filter arrangement 24 and a valve seat 29. The valve seat 29 is part of a schematically drawn solenoid valve 30, which can be screwed onto a flange segment 31. The flange segment 31 can have an internal thread 32 for this purpose. The flange segment 31 can be configured as a single piece with the valve housing 17.

Solenoid valves 30 can be connected to a control apparatus of the household dishwasher 1, which is for example set up to control the operation of the household dishwasher 1 and to open and close the inlet valve arrangements 15, 16. The inlet valve arrangements 15, 16 are provided for connection to a water network (not shown in detail). One of the inlet valve arrangements 15, 16 can be connected for example to a cold water connection and the other to a warm or hot water connection of the water network, to supply the household dishwasher 1 with cold or preheated water.

The water supply system to the household dishwasher 1 can have two water supply lines, for example in the form of a first water hose connected to the first inlet valve arrangement 15 and a second water hose connected to a second inlet valve arrangement 16. The ends of the water hoses away from the inlet valve arrangements 15, 16 are connected to an appliance intake of the household dishwasher 1. The water from the water connections passes by way of the appliance intake into the washing compartment 2, to be mixed with a detergent to form the washing liquor.

The water supply system can be embodied as a water stop system and can therefore comprise a safety mechanism to prevent the supply of water in the event of a defect, in particular in the water hoses, in that the control apparatus blocks the inlet valve arrangements 15, 16 for example automatically. For this purpose both water hoses can also run within outer hoses, which are for example corrugated hoses. If the water hoses are not leaktight, the outer hoses can catch any escaping water.

FIG. 2 shows the sealing disk 28 in its open position. In the position of the sealing disk 28 shown there is a gap between the annular rib 27 of the seat surface 26 in the manner of an annular disk and the upper face of the sealing disk 28, so that water can flow from the inflow connection 18 to the outflow connection 20 when the solenoid valve 30 releases the valve seat 29. In this open position the lower face of the sealing disk 28 rests on a recess 33 in the valve housing 17, a lateral channel in the manner of a gap 34 allowing a flow around the sealing disk 28.

Figure 3:
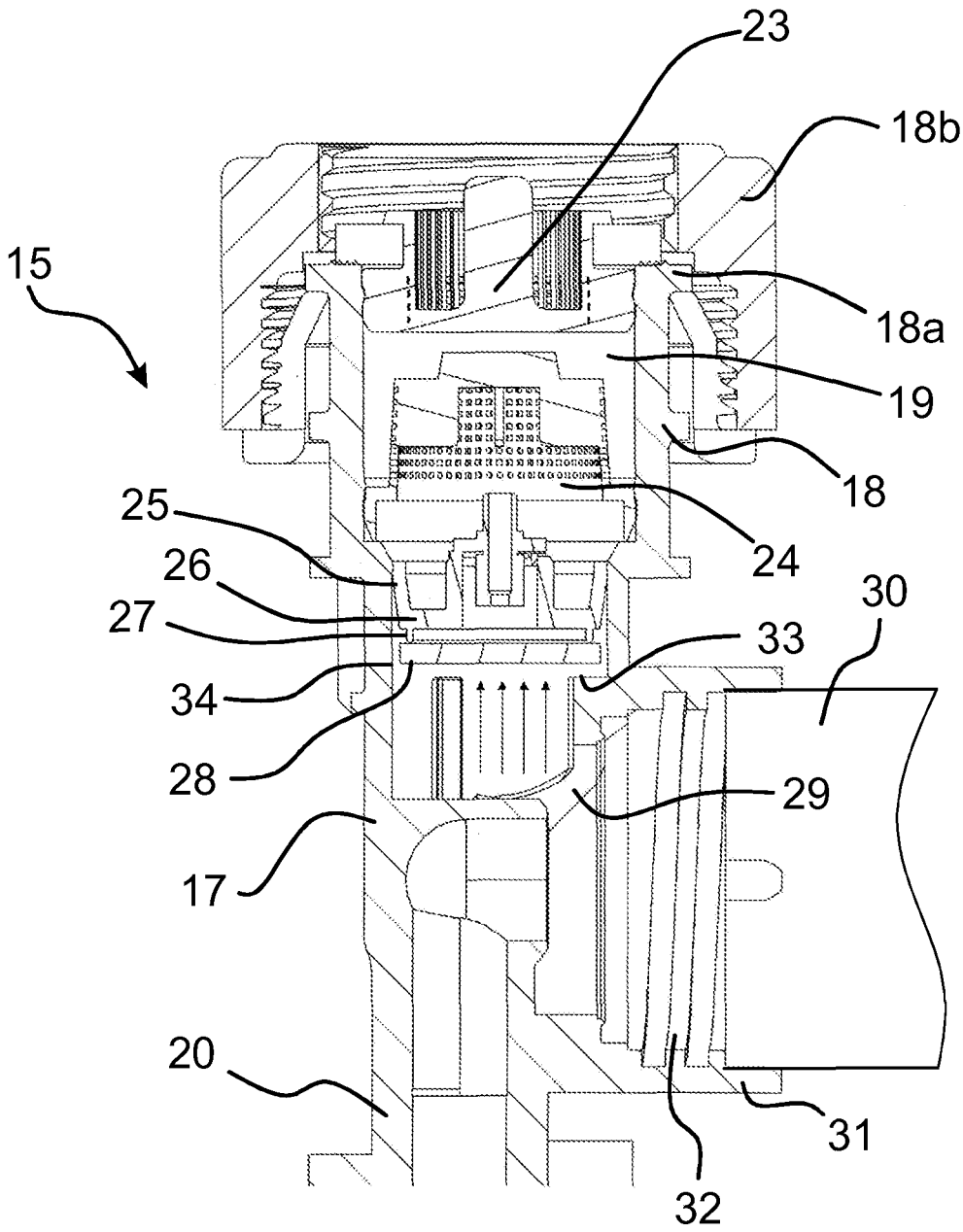
FIG. 3 shows the first embodiment of the inlet valve according to FIG. 2 with the sealing disk in the closing position.

FIG. 3 shows the sealing disk 28 in its closing position. In the position of the sealing disk 28 shown the upper face of the sealing disk 28 rests on the annular rib 27 of the seat surface 26 in the manner of an annular disk in such a manner that it provides a fluid-tight seal all round its periphery. A water flow coming from the outflow connection 20 pushes the sealing disk 28 upward against the annular rib 27 of the seat surface 26 in the manner of an annular disk so that a water flow in the direction of the water network is prevented in this closing position.

Figure 4:
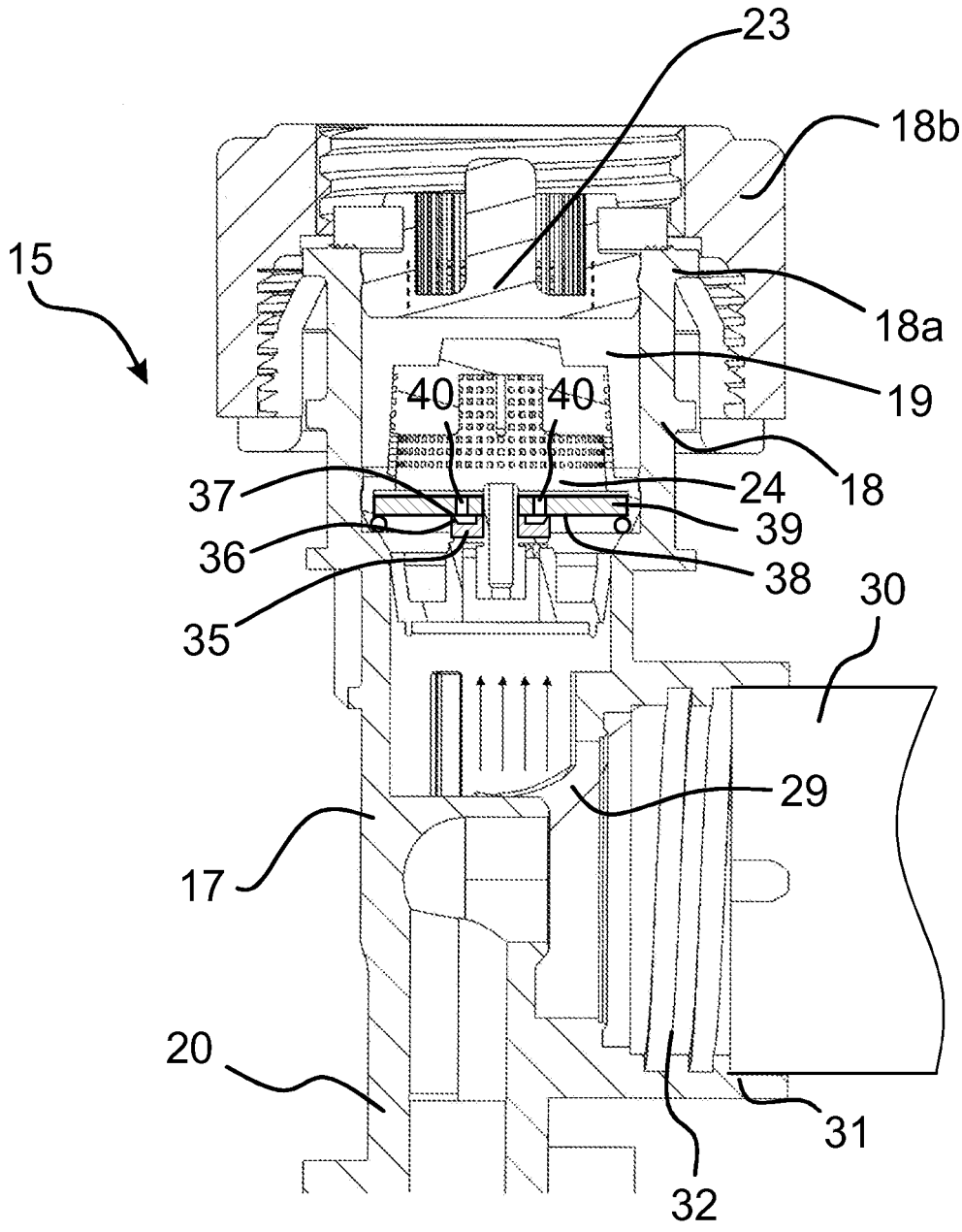
FIG. 4 shows a second advantageous embodiment of an inlet valve, which is configured as part of a water stop valve arrangement of the household dishwasher, with a membrane ring in the open position.

In FIG. 4 the sealing disk 28 according to FIGS. 2 and 3 is replaced by a membrane ring 35. On an upper peripheral segment the membrane ring 35 supports an in particular annular peripheral sealing lip 36. The sealing lip 36 is disposed with its free sealing lip edge 37 inclined radially outward. In the closing position shown the sealing lip 36 rests on a seat 38. The seat can be provided on a disk-type insert 39. To this extent the membrane ring 35 together with the sealing lip 36 and the seat 38 forms a second embodiment of an inventive backflow prevention apparatus 22.

The disk-type insert 39 can be inserted as a separate insertion piece into the flow channel 19 of the valve housing 17 or can be configured as a single piece with this. In the closing position shown the sealing lip 36 runs around throughflow openings 40, which are introduced in the disk-type insert 39.

Figure 5:
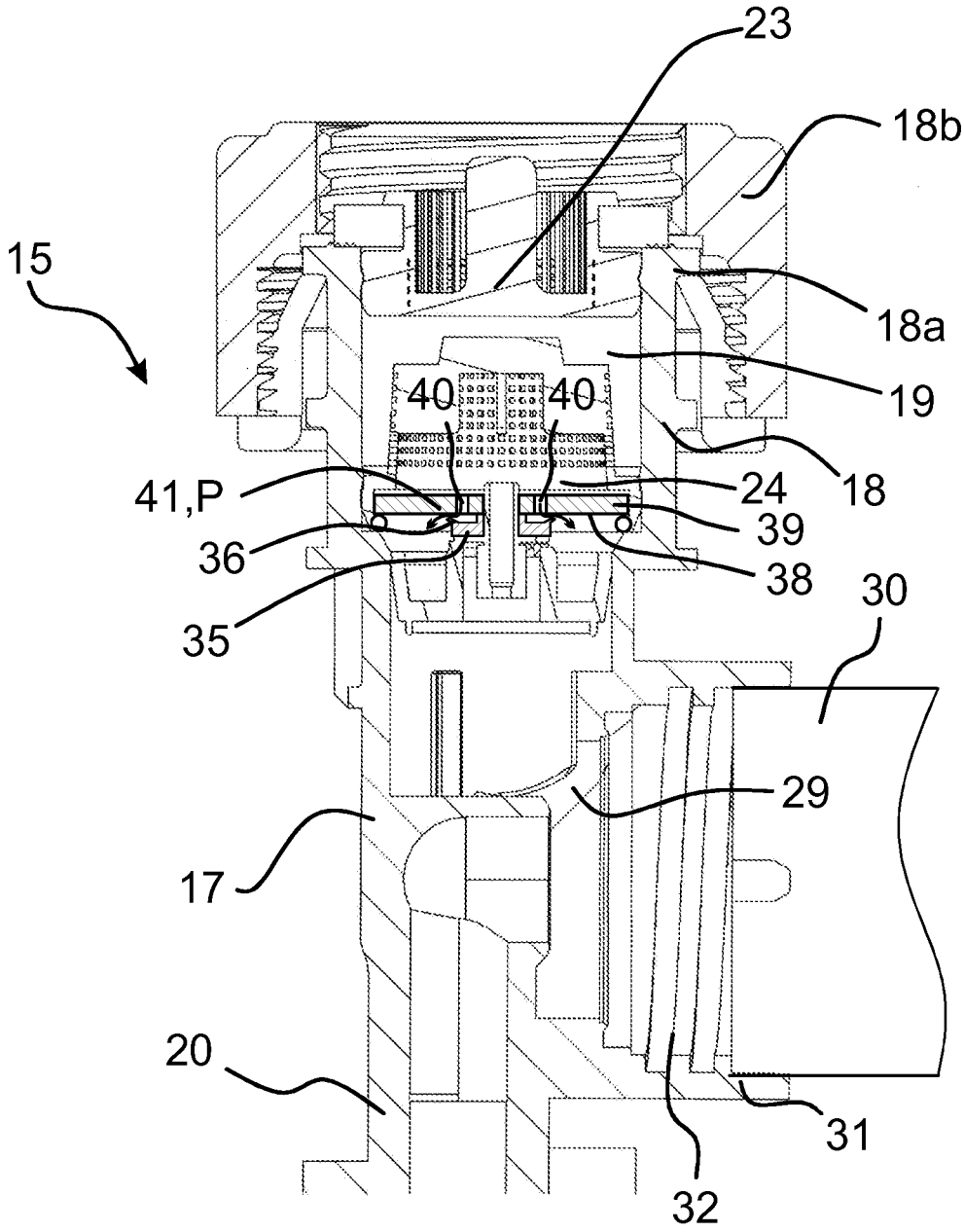
FIG. 5 shows the second embodiment of the inlet valve according to FIG. 4 with a membrane ring in the closing position.

FIG. 5 shows the membrane ring 35 in its open position. The disk-type insert 39 here forms an annular gap 41 with the sealing lip 36 of the membrane ring 35. Water can flow from the inflow connection 18 to the outflow connection 20 by way of the annular gap 41, as shown by the arrows P, when the solenoid valve 30 releases the valve seat 29.

Figure 6:
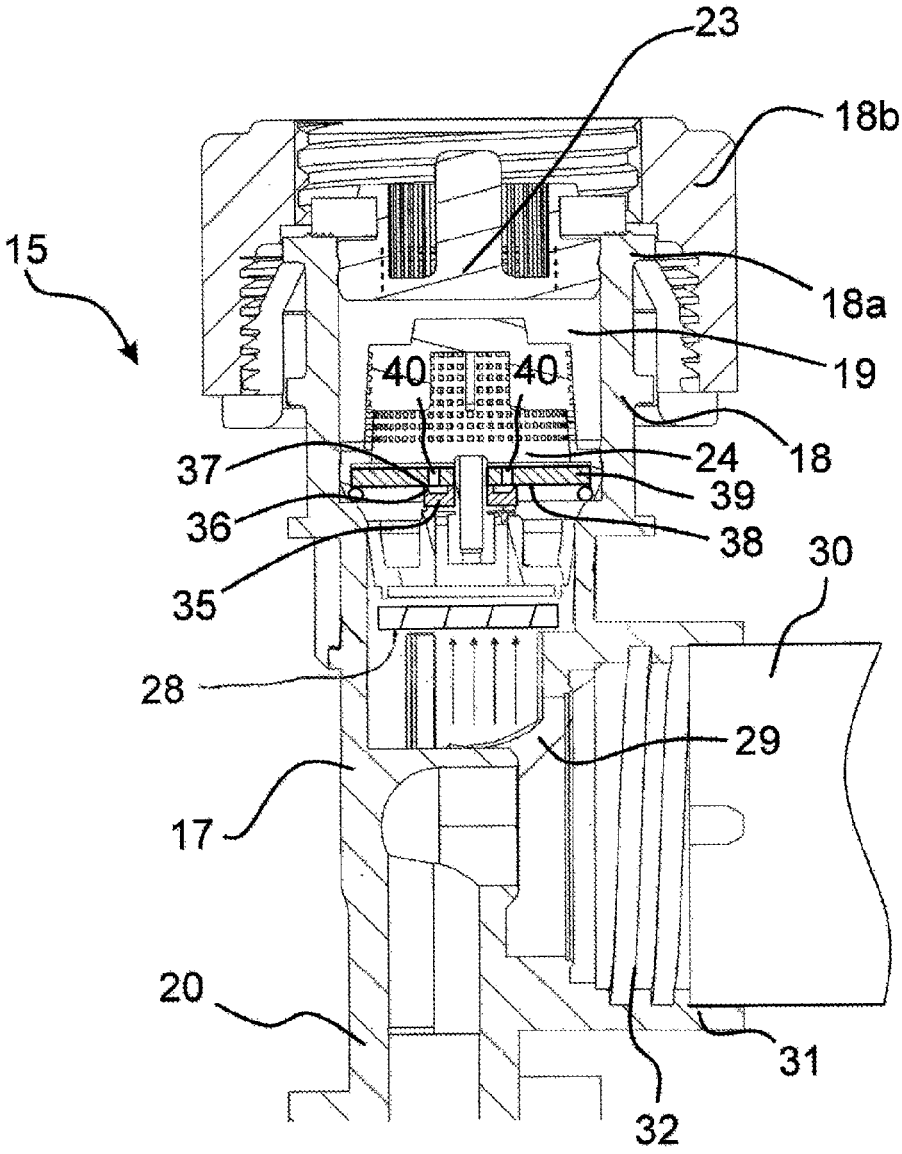
FIG. 6 shows a third advantageous embodiment of an inlet valve, which is configured as part of a water stop valve arrangement of the household dishwasher, with a sealing disk in the open position and a membrane ring in the closed position.
Figure 7:
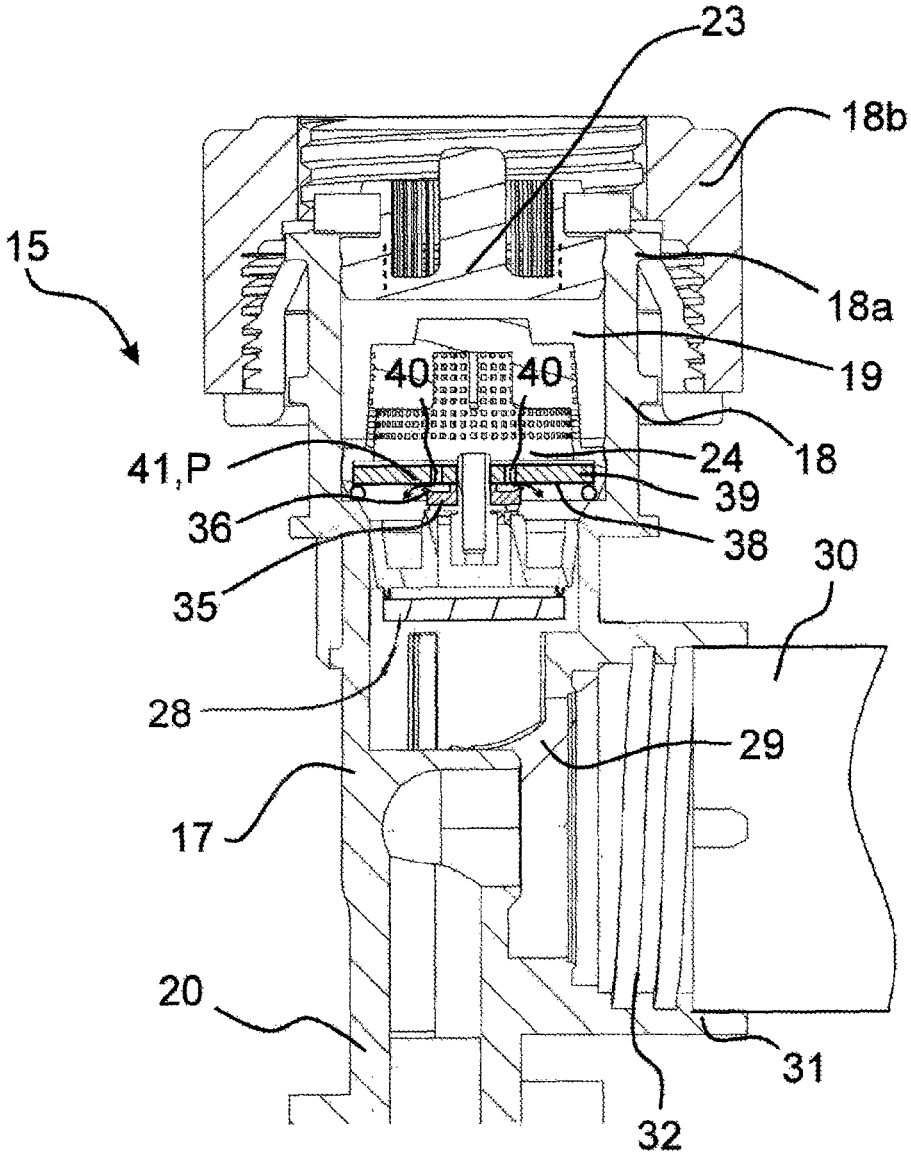
FIG. 7 shows the third embodiment of the inlet valve according to FIG. 6 with a sealing disk in the closed position and a membrane ring in the open position.

FIGS. 6 and 7 show an embodiment that includes both sealing disk 28 and membrane ring 35. FIG. 6 shows sealing disk 28 in the open position and membrane ring 35 in the closed position. FIG. 7 shows sealing disk 28 in the closed position and membrane ring 35 in the open position.

What is claimed is:

1. A water conducting household appliance, comprising:

at least one water supply line to supply the household appliance with water from a water network;

a solenoid valve having a valve seat;

an inlet valve housing connected to the water supply line and connected to the water network, the inlet valve housing having a solenoid valve mount, the solenoid valve being mounted to the inlet valve housing at the solenoid valve mount such that the valve seat is positioned in the inlet valve housing and interacts with the inlet valve housing to alternately allow or prevent flow of water through the inlet valve housing; and a backflow prevention apparatus arranged in the inlet valve housing and structured to allow water flow only in a direction of the household appliance and to prevent the water flow in a direction of the water network, wherein the backflow prevention apparatus has a sealing disk that is supported in a movable manner in the inlet valve housing, the sealing disk is moved into an open position by a water pressure of the water flow in the direction of the household appliance, the sealing disk resting on a portion of the inlet valve housing in the open position, the sealing disk is moved into a closing position by a water pressure of the water flow in the direction of the water network, and in the closing position, the sealing disk rests on a sealing disk seat in a fluid-tight manner.

2. The household appliance of claim 1, further comprising a plurality of inlet valve housings to supply the household appliance with water from the water network, wherein each of the plurality of inlet valve housings has a respective backflow prevention apparatus that is arranged in an assigned one of the plurality of inlet valve housings, the respective backflow prevention apparatus structured to allow the water flow only in the direction of the household appliance and to prevent the water flow in the direction of the water network.

3. The household appliance of claim 1, wherein the backflow prevention apparatus is arranged between the at least one water supply line and the solenoid valve.

4. The household appliance of claim 1, wherein the backflow prevention apparatus is a non-return valve.

5. The household appliance of claim 1, wherein the sealing disk is disposed in a flow channel between the first filter arrangement and the solenoid valve.

6. The household appliance of claim 1, wherein the sealing disk seat is formed by an insertion piece having a seat surface in form of an annular disk, wherein the seat surface has an annular rib projecting axially in a direction of the sealing disk; and wherein, in the closing position, the sealing disk rests on the annular rib.

7. The household appliance of claim 1, wherein the household appliance is one of a household dishwasher and a washing machine.

8. The household appliance of claim 1, further comprising a first filter arrangement arranged between the at least one water supply line and the backflow prevention apparatus.

9. The household appliance of claim 1, further comprising a first filter arrangement located in the inlet valve housing; and a second filter arrangement located in the inlet valve housing.

10. The household appliance of claim 9, wherein the second filter arrangement is arranged between the at least one water supply line and the first filter arrangement.

11. The household appliance of claim 1, further comprising a second backflow prevention apparatus arranged in the inlet valve housing and structured to allow water flow only in the direction of the household appliance and to prevent the water flow in the direction of the water network, wherein the second backflow prevention apparatus has a membrane ring secured in the inlet valve housing, by a second water pressure of the water flow in the direction of the household appliance, the membrane ring is reshaped elastically into a membrane open position, the membrane ring has a sealing lip that is pushed by a second water pressure of the water flow in the direction of the water network into a membrane closing position, and in the membrane closing position, the sealing lip of the membrane ring rests on a membrane seat in a fluid-tight manner.

12. The household appliance of claim 11, wherein in the membrane closing position, the membrane ring prevents water from flowing into the throughflow openings.

13. The household appliance of claim 12, wherein the membrane ring has an upper surface that faces the membrane seat, and a portion of the upper surface does not contact the membrane seat in the membrane open position and does contact the membrane seat in the membrane closing position.

14. The household appliance of claim 11, wherein the membrane ring is disposed in a flow channel between a filter arrangement and the solenoid valve.

15. The household appliance of claim 11, wherein the membrane seat is formed by a disk-type insert having throughflow openings, and the throughflow openings are closed by the sealing lip of the membrane ring in the membrane closing position.

16. The household appliance of claim 15, wherein the disk-type insert forms an annular gap with the sealing lip of the membrane ring.

17. The household appliance of claim 16, wherein, in the membrane closing position, the sealing lip is disposed such that a free sealing lip edge of the sealing lip is inclined radially outward.

18. The household appliance of claim 16, wherein, in the membrane open position, the sealing lip is disposed such that a free sealing lip edge of the sealing lip inclined radially outward.

* * * * *